US010737129B2

(12) United States Patent
Clark et al.

(10) Patent No.: US 10,737,129 B2
(45) Date of Patent: Aug. 11, 2020

(54) COVER ASSEMBLIES FOR USE IN COVERING A SAND AREA OF A JUMP PIT

(71) Applicant: Sportsfield Intellectual, LLC, Delhi, NY (US)

(72) Inventors: Sean R. Clark, Delhi, NY (US); Andrew P. Hannigan, Delhi, NY (US); Eric W. Hulbert, Delhi, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 0 days.

(21) Appl. No.: 15/957,267

(22) Filed: Apr. 19, 2018

(65) Prior Publication Data

US 2019/0321673 A1 Oct. 24, 2019

(51) Int. Cl.

| | |
|---|---|
| ***A63B 6/02*** | (2006.01) |
| ***E04H 4/10*** | (2006.01) |
| ***E04B 7/16*** | (2006.01) |
| ***A63C 19/12*** | (2006.01) |

(52) U.S. Cl.

CPC ..... *A63B 6/025* (2013.01); *A63C 19/12* (2013.01); *E04B 7/166* (2013.01); *E04H 4/10* (2013.01)

(58) Field of Classification Search

CPC ..... A63B 6/025; A63C 19/12; E04H 4/10; E04B 7/166

USPC ..... 482/14, 15; 4/498, 502, 488, 500, 501, 4/506, 505

See application file for complete search history.

(56) References Cited

U.S. PATENT DOCUMENTS

| | | | | |
|---|---|---|---|---|
| 2,958,872 A * | 11/1960 | Meyer, Jr. | E04H 4/10 | 160/378 |
| 3,050,743 A * | 8/1962 | Lamb | E04H 4/101 | 135/903 |
| 3,076,975 A * | 2/1963 | Lamb | E04H 4/101 | 160/26 |
| 3,864,761 A * | 2/1975 | Stalder | E04H 4/082 | 4/502 |
| 4,324,370 A * | 4/1982 | Guard | E04H 4/101 | 242/403 |
| 4,762,242 A * | 8/1988 | Harris | E04H 5/06 | 137/234.6 |
| 4,939,798 A * | 7/1990 | Last | E04H 4/101 | 4/502 |

(Continued)

OTHER PUBLICATIONS

"Sand Pit Forms and Cover Systems," Gill Athletics, http://www.gillathletics.com/facilityCD/facilityCDsub_files/Page574.htm, 2-pages, Apr. 24, 2007.

(Continued)

*Primary Examiner* — Joshua K Ihezie

(74) *Attorney, Agent, or Firm* — Heslin Rothenberg Farley and Mesiti PC

(57) ABSTRACT

A cover assembly may include a housing and an elongated cover. The housing defines a chamber therein. The chamber is disposable in the ground adjacent to a side of the sand area of the jump pit. The elongated cover has a first end, a second end, and spaced-apart sides extending from the first end to the second end. The elongated cover is storable in a compacted configuration in the chamber of the housing below the surface of the ground, and the elongated cover is removable from the chamber and extendable in an uncompacted configuration over the sand area of the jump pit to conceal the sand area.

29 Claims, 13 Drawing Sheets

(56) References Cited

U.S. PATENT DOCUMENTS

| | | | | |
|---|---|---|---|---|
| 5,421,041 | A * | 6/1995 | Stern | E04H 4/10 24/563 |
| 5,913,613 | A * | 6/1999 | Ragsdale | E04H 4/101 4/498 |
| 6,324,706 | B1 * | 12/2001 | Epple | E04H 4/101 4/502 |
| 6,519,788 | B1 * | 2/2003 | Epple | E04H 4/101 4/498 |
| 7,641,593 | B2 * | 1/2010 | Goulet | A63B 6/025 482/15 |
| 7,694,356 | B2 * | 4/2010 | Bouiss | E04H 4/101 4/498 |
| 8,186,125 | B2 * | 5/2012 | Goulet | A63B 6/025 52/741.1 |
| 8,745,955 | B2 | 6/2014 | Goulet | |
| 8,920,289 | B2 | 12/2014 | Query, Jr. et al. | |
| 2003/0046805 | A1 * | 3/2003 | Mathis | E04H 4/101 29/525.02 |
| 2003/0097709 | A1 * | 5/2003 | Smith | E04H 4/101 4/498 |
| 2004/0117904 | A1 * | 6/2004 | Ragsdale | E04H 4/101 4/502 |
| 2006/0252603 | A1 * | 11/2006 | Goulet | A63B 6/025 482/15 |
| 2012/0073039 | A1 * | 3/2012 | Hotaling | E04H 4/06 4/498 |
| 2012/0184411 | A1 * | 7/2012 | Query, Jr. | A63B 5/00 482/15 |
| 2012/0240324 | A1 * | 9/2012 | Callahan | B32B 37/15 4/502 |
| 2012/0278987 | A1 * | 11/2012 | Marelli | F16F 1/128 4/503 |
| 2015/0184409 | A1 * | 7/2015 | Karales | E04H 4/141 4/498 |

OTHER PUBLICATIONS

F440-29'-7" LJ TJ Sandpit Form with Sand Catcher Specifications; Gill Athletics, Champaign, IL, 9-pages, Oct. 22, 2004.

F420-29' LJ TJ Sandpit Form with Ledge Specification, Gill Athletics, Champaign, IL, 6-pages, Oct. 22, 2004.

F400-29' LJ TJ Sandpit Form Specifications, Gill Athletics, Champaign, IL, 6-pages, Oct. 22, 2004.

Cages and Inground Equipment, Section 2, Long Jump/Triple Jump Pit, Sand Catcher and Cover System, UCS Track & Field, Sports and Recreational Products, http://www.ec-securehost.com/UCSInc/Cages.sub.-and.sub.-Ingro- und.sub.-Equipment.sub.-sub.--Section.sub.-2.html, 5-pages, Dec. 12, 2003.

Jump Pit Systems Brochure, Sports Edge, 8 pages, 2000.

NCAA and High School Long/Triple Jump Sand Pit with Sand Catchers and Cover Ledge, Sports Edge, Model Nos. SP6000, SP6010, SP6020, SP6012, SP6022, SP6014, SP6024, Cut Sheets and Installation Instructions, 17-pages, 2002.

Steeple Chase Water Jump Pit, Sports Edge, Model No. WJ5000, Cut Sheets and Installation Notes, 7-pages, 2002.

* cited by examiner

COVER ASSEMBLIES FOR USE IN COVERING A SAND AREA OF A JUMP PIT

TECHNICAL FIELD

The present disclosure relates generally to jump pits and, more specifically, to cover assemblies for use in covering a sand area of a jump pit.

BACKGROUND

Jump pits, which are well known in field sports, are used as a reasonably safe landing place in athletic activities for long jumps and triple jumps.

Typically, jump pits are covered when not in use for preventing sand displacement (via wind, etc.), preventing contamination via organic growth and animal waste, deterring unauthorized use, improving facility aesthetics, and in some cases providing a safety precaution. The two most common methods for covering jump pits include modular aluminum cover panels, or a vinyl/mesh fabric with a weighted perimeter.

Aluminum covers rest on a ledge of the jump pit, are approximately 2 feet, 6 inches by 10 feet per panel, require a set of approximately 8 to 12 panels to accommodate one jump pit, and feature a ½ inch recess on the top-side that is coated with a rubber track material surfacing that is installed on the running track.

Vinyl/mesh covers are slightly oversized relative to the footprint of the jump pit, and include a perimeter weight to keep the cover in place. The weight is typically an integral chain or a series of sand bags. The vinyl/mesh covers are generally lighter and more convenient to put in place, particularly when being placed on and taken off with regularity compared to aluminum covers.

U.S. Pat. No. 7,641,593, issued to Goulet, discloses a jump pit form for constructing a jump pit with a sand area. The form is constructed in sections. Each section has an inside wall and an outside wall. A support member is located between the outside wall and the inside wall. The sections are secured together onsite. Caps are mounted on the support members. The caps include an inclined surface which slopes upwardly and away from the sand area forming the inclined surface. A cover over the sand area is supported by the inclined surface. Optionally, a chamber is located adjacent the outside wall. A grate covers the chamber and the grate is supported by a brace. A mat covers the grate. Openings in the grate and in the mat permit sand through them, thrown from the sand area to drop into the chamber.

SUMMARY

Shortcomings of the prior art are overcome and additional advantages are provided through the provision, in one embodiment, of a cover assembly for use in covering a sand area of a jump pit. The cover assembly may include, for example, a housing defining a chamber therein, the chamber being disposable in the ground adjacent to a side of the sand area of the jump pit, and an elongated cover having a first end, a second end, and spaced-apart sides extending from the first end to the second end. The elongated cover is storable in a compacted configuration in the chamber of the housing below the surface of the ground, and the elongated cover is removable from the chamber and extendable in an uncompacted configuration over the sand area of the jump pit to conceal the sand area.

In another embodiment, a jump pit system includes, for example, a base form having a first side, a second side, and spaced-apart sides extending from the first side to the second side to define a sand area of a jump pit, and a retractable cover assembly operably attachable to the first side of the base form. The retractable cover assembly includes, for example, a housing defining a chamber therein, the chamber being disposable in the ground, and a monolithic elongated cover having a first end, a second end, and spaced-apart sides extending from the first end to the second end. The elongated cover is storable in a compacted configuration in the chamber of the housing below the surface of the ground, and the elongated cover is removable from the chamber and extendable in an uncompacted configuration over the sand area of the jump pit to conceal the sand area.

In another embodiment, a method including, for example, removing a cover from a chamber underneath the surface of the ground alongside a sand area of a jump pit, and positioning the cover over the sand area of the jump pit to conceal the sand area.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

As described in greater detail below, the present disclosure, in which in some embodiments, is directed to jump pit systems that may include an integral vinyl/mesh fabric sand pit cover that retracts and/or rolls up when not in use, and stows within a sub-grade compartment, cavity, or chamber at the far end of the sand pit. For example, jump pit systems may utilize the far end of the sand pit as a storage compartment to house a rolling/retractable cover mechanism. The cover may be pulled out and securely attached at the opposite end of the sand pit when necessary, and conveniently retracted or rolled up and stowed out of sight when not in use. The storage compartment itself may have one or more solid n access panel that can be temporarily raised or removed such that it can be set back into place when the fabric cover is fully extended.

Figure 1:
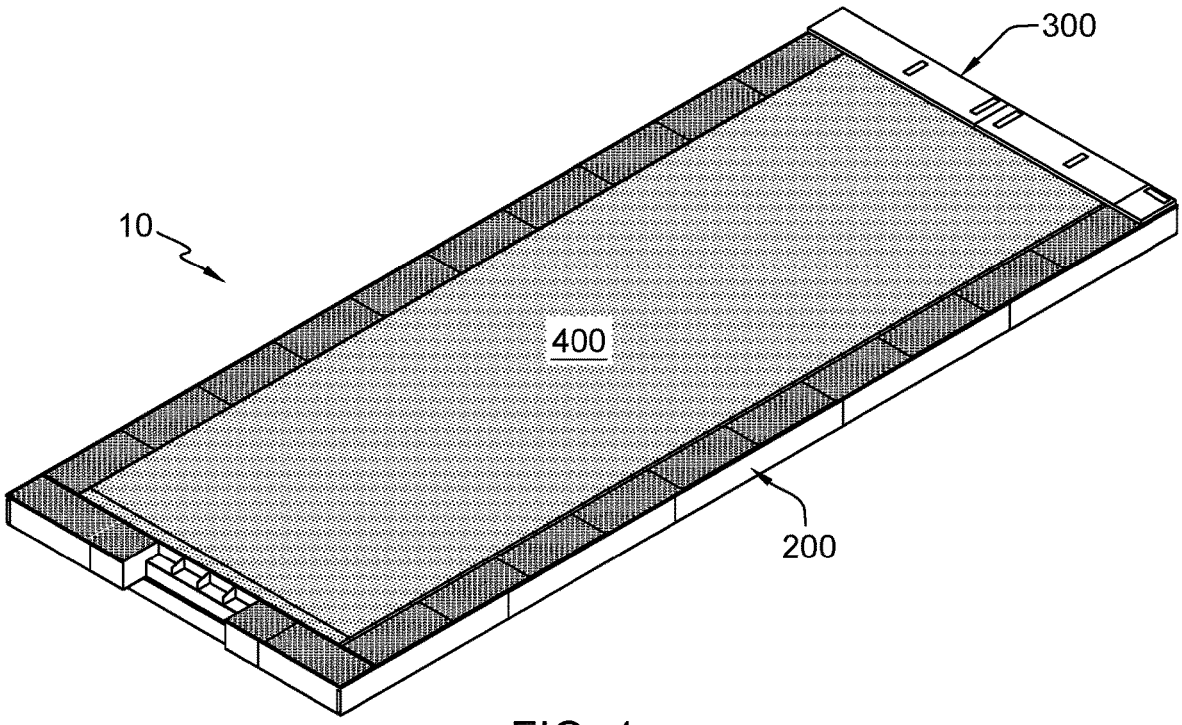
FIG. 1 is a perspective view of a jump pit system according to an embodiment of the present disclosure having a cover assembly with a retractable cover disposed in a fully uncompacted configuration extendable to conceal a sand area of a jump pit.
Figure 2:
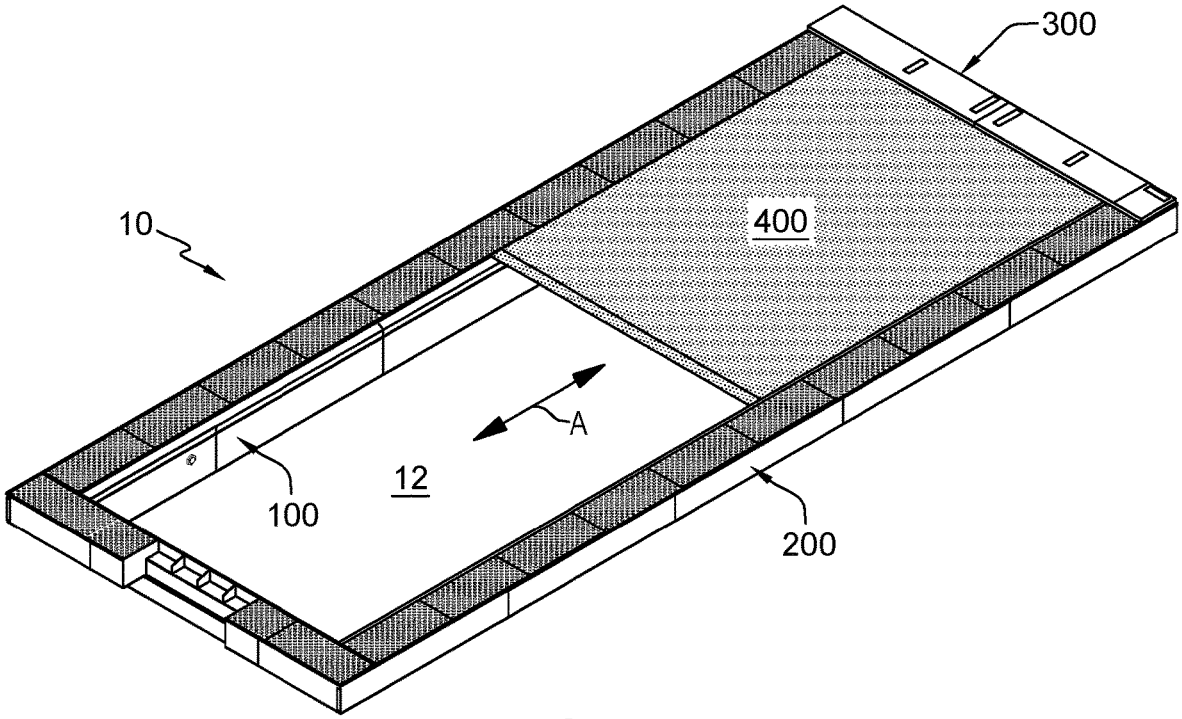
FIG. 2 is a perspective view of the jump pit system of FIG. 1 with the retractable cover disposed in a partially uncompacted configuration covering a portion of a sand area and uncovering a portion of the sand area.
Figure 3:
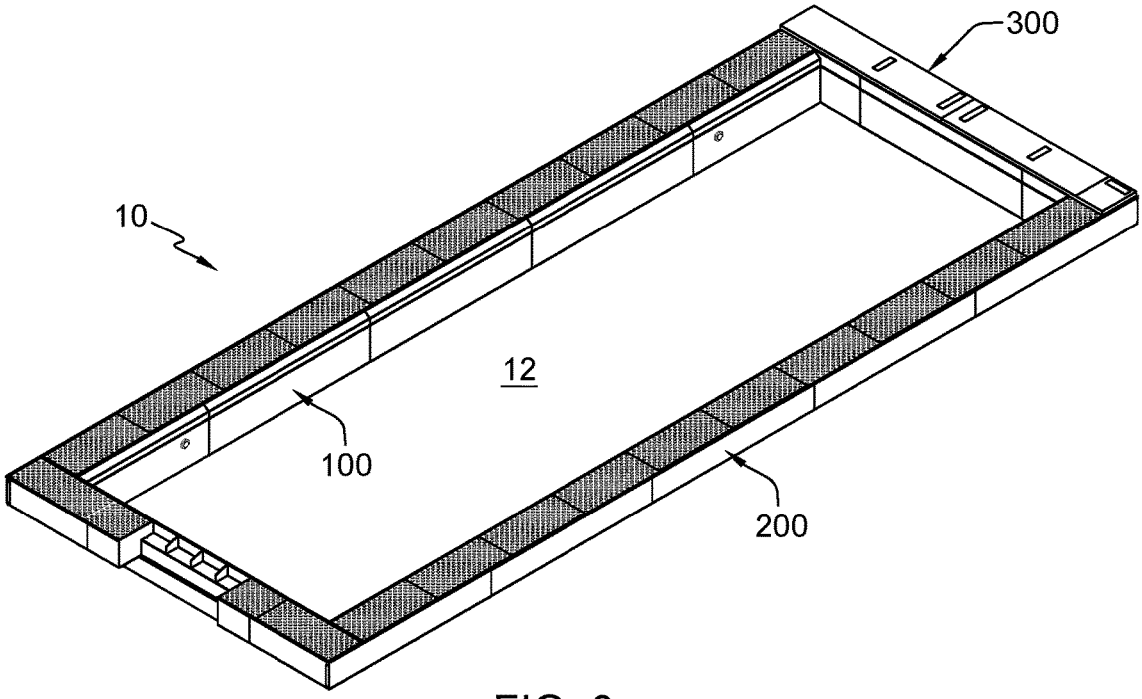
FIG. 3 is a perspective view of the jump pit system of FIG. 1 with the retractable cover disposed in a fully retracted compacted configuration, stored in the cover assembly, and uncovering the sand area.

FIGS. 1-3 illustrate a jump pit system 10 according to an embodiment of the present disclosure. In this illustrated embodiment, jump pit system 10 may generally include a base form 100 (FIGS. 2 and 3), a sand catcher 200, and a cover assembly 300 having a cover 400 (FIGS. 1 and 2). For example, cover assembly 300 may be a retractable cover assembly, and cover 400 may be a retractable cover. Retractable cover 400 may be disposed in a fully uncompacted extended covering position extending over and concealing a sand area (not shown in FIG. 1), disposed in a partially extended/retracted position partially covering and concealing a first portion of sand area 12 and uncovering a second portion of sand area 12 as shown in FIG. 2, and disposed in a fully retracted compacted fully or completely uncovering sand area 12 as shown in FIG. 3. With reference again to FIG. 2, retractable cover 400 is moveable towards a retracted position and an extended position in the direction of double headed arrow A. Retractable cover 400 may extend from one end of jump pit system 10 to an opposite end in a fully extended position as shown in FIG. 1, and be disposed in a chamber in retractable cover assembly 400 of jump pit system 10 such as under the surface of the ground or athletic field.

Figure 4:
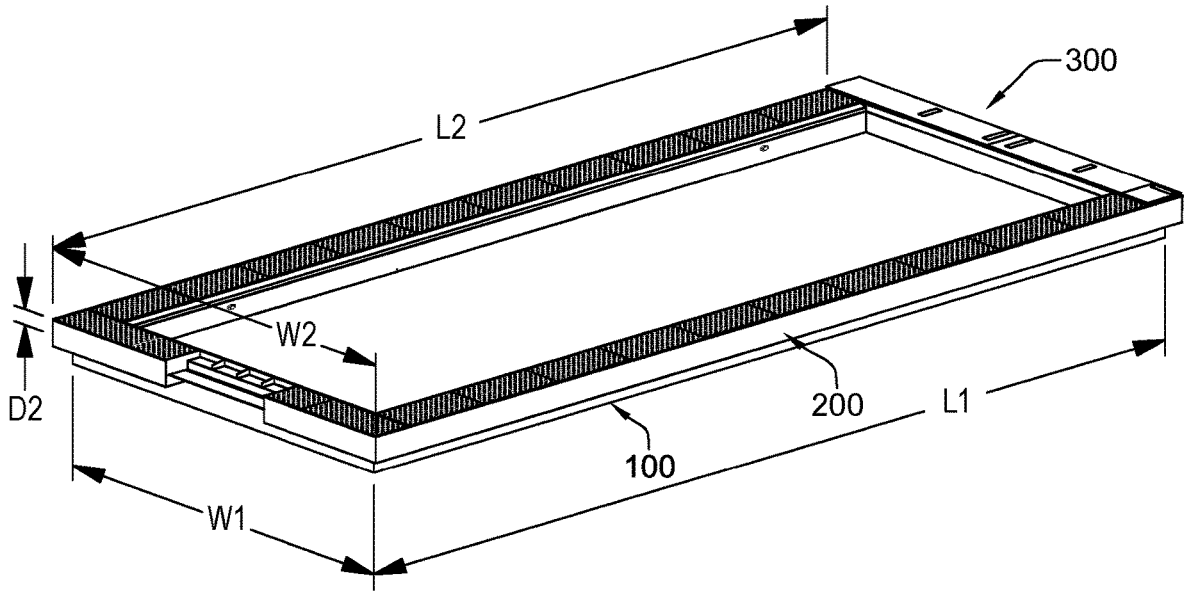
FIG. 4 is a side perspective view of the jump pit system of FIG. 1 with the retractable cover in a retracted compacted configuration and illustrating the base form and the sand catcher.

With reference to FIG. 4, sand catcher 200 and a retractable cover assembly 300 may be disposed on or attachable to a top of base form 100.

Figure 5:
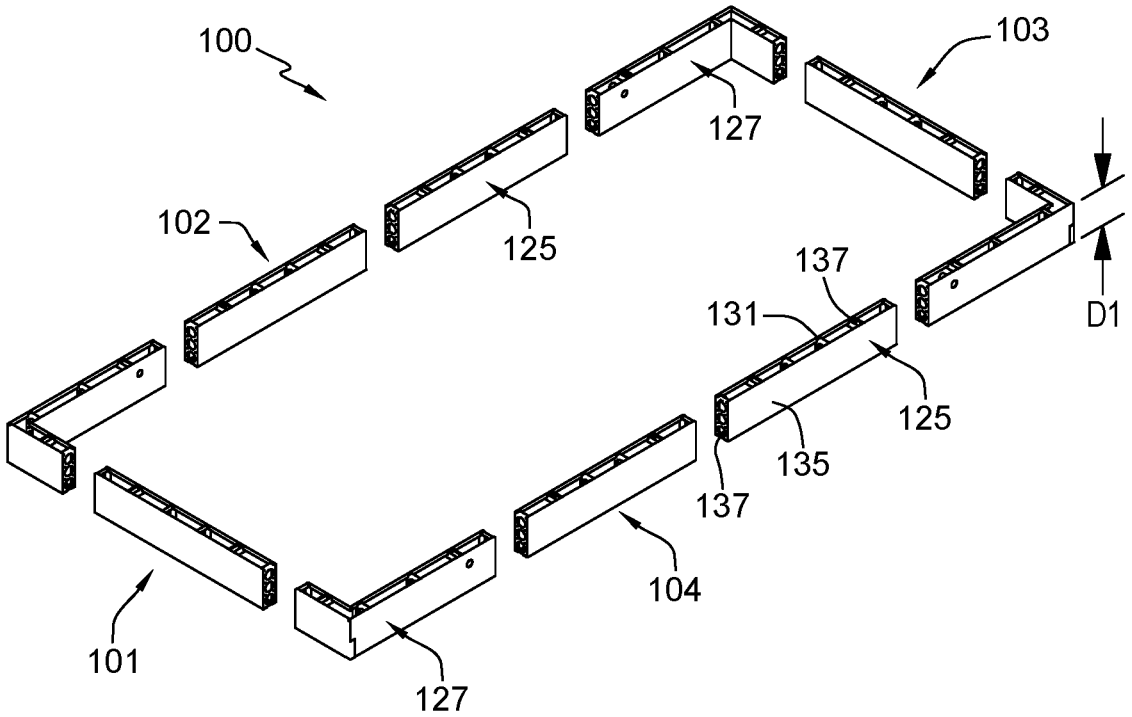
FIG. 5 is an exploded perspective view of the base form of the jump pit system of FIG. 1.

As shown in FIG. 5, base form 100 may have a generally rectangular configuration having a pair of major sides 102 and 104, and a pair of minor sides 101 and 103. Base form 100 may be prefabricated in sections such as a plurality of straight sections 125 and a plurality of corner sections 127. The sections may be operably connected together and filled with cement when installed in the ground. A top of base form 100 may be located underneath the surface of an athletic field.

For example, straight section 125 may have an inside wall 131, which is located toward the inside of the sand area and an outside wall 135 facing away from the sand area. Both outside wall 135 and inside wall 131 have interior surfaces where support members 137 are located. Support members 137 may be secured to outside wall 135 and to inside wall 131, preferably by welding, or by other means such as with bolts. Support members 137 may be spaced from one another to assure that inside wall 131 and outside wall 135 neither bulges nor separates from one another in the placement of the cement between inside wall 131 and outside wall 135.

Each corner section 127 may include a short portion and a long portion. As shown in FIG. 5, the short portion is disposed along minor sides 101 and 103 of base form 100. The long portion is disposed along the major sides 102 and 104 of base form 100. Each corner section may include inners walls, outer walls, and support sections similar to the straight sections described above. The sections may be operably secured together at the site of installation by welding or bolts, or other fasteners.

A cross-section of the base form may have a width of about 6 inches and a depth of about 16 inches. The base form may have an outer width W1 (FIG. 4) of about 11 feet, an outer length L1 (FIG. 4) of about 25 feet, and a depth D1 (FIG. 5) of about 16 inches. The inside walls, the outside walls, and the support members in the straight sections and the corner sections may be formed from sheet metal, preferably aluminum. Suitable straight sections and corner sections for use in a base form of jump pit systems of the present disclosure are described and illustrated in U.S. Pat. Nos. 7,641,593; 8,186,125; and 8,745,955 issued to Goulet, the entire contents of which are hereby incorporated by reference. It will be appreciated that other straight sections, corner sections, and base forms may be suitably employed.

Figure 6:
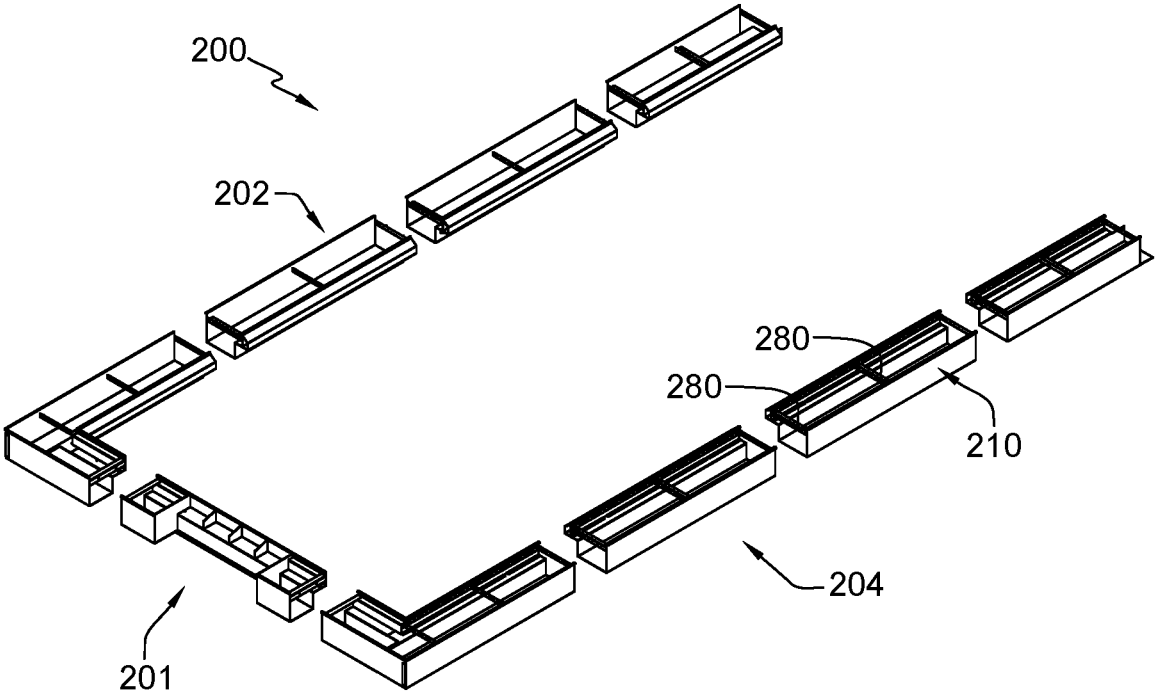
FIG. 6 is an exploded perspective view of the sand catcher of the jump pit system of FIG. 1.

As shown in FIG. 6, sand catcher 200 may have a generally U-shaped configuration having a pair of major sides 202 and 204, and a minor side 201. Sand catcher 200 is operably attached and/or supported on the top of base form 100 (FIG. 5). Sand catcher 200 is disposed around a perimeter of the base form for capturing and storing displaced sand that escapes the pit. Sand catcher 200 may also be made in sections 210, which are secured together, at the site of installation. Sand catcher 200 surrounds most of the sand area, but not necessarily all of the sand area. For example, the sand catcher may extend along the major sides and the front minor side of the sand area.

Figure 7:
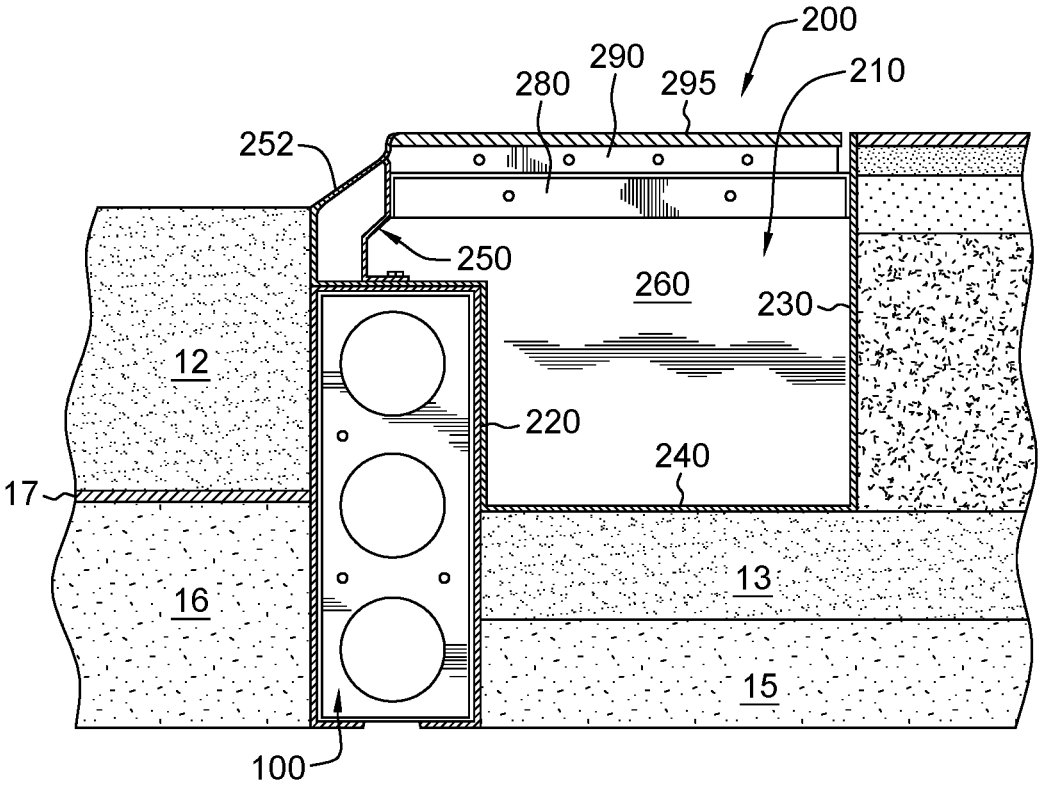
FIG. 7 is a cross-sectional view of the base form with the sand catcher of the jump pit system of FIG. 1 installed in the ground.

FIG. 7 illustrates base form 100 and sand catcher 200 disposed in the ground such as in an athletic field. Section 210 of the sand catcher may include an inner wall 220, an outer wall 230, a bottom wall 240, and a cap 250 that define a chamber 260 therein. Cap 250 has an inclined surface 252 that faces sand area 12. Cap 250 may be secured to braces 280, which extend across the sand catcher and are secured at opposite ends to outside wall 230. Braces 280 are located at both ends of each sand catcher section 210 and at the center of each sand catcher section 210 as shown in FIG. 6. A grate 290, preferably made of aluminum, is supported by braces 280. A mat 295 preferably of a rubber composition is placed over grate 290. Grate 290 and mat 295 have openings through them to permit sand to pass through them and then to drop into chamber 260. Sections 210 may rest upon compacted sand 13, which compacted sand 13 is placed upon crushed stone 15. Beneath sand area 12, may be crushed stone 16 with a thin layer of Geotextile 17 disposed between the crushed stone and the sand in the sand area 12. A sand catcher may have an outer width W2 (FIG. 4) of about 13 feet, an outer length L2 (FIG. 4) of about 24.5 feet, and a depth D2 (FIG. 4) of about 8 inches. The inside walls, the outside walls, the cap, and the braces may be formed from sheet metal, preferably aluminum. Suitable sand catchers for use in jump pit systems of the present disclosure are described and illustrated in U.S. Pat. Nos. 7,641,593; 8,186,125; and 8,745,955 issued to Goulet, the entire contents of which are hereby incorporated by reference. It will be appreciated that other sand catchers may be suitable employed, or that no sand catchers need be employed in the jump pit systems of the present disclosure.

Figure 8:
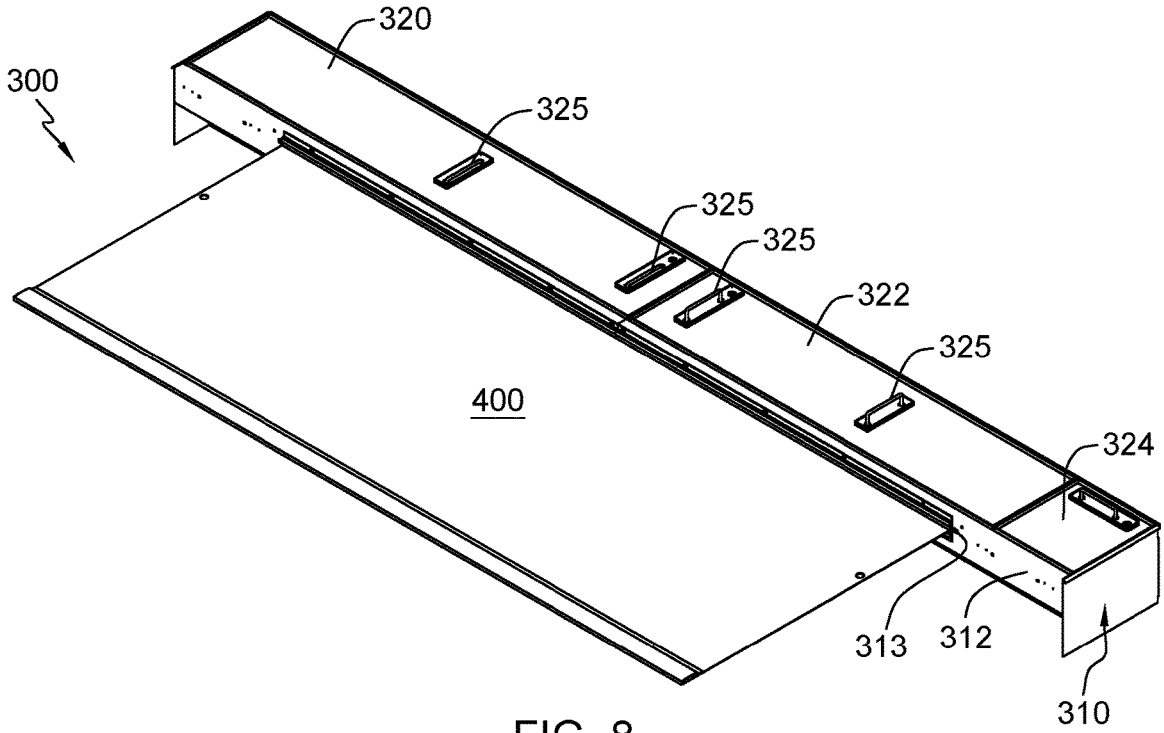
FIG. 8 is an enlarged perspective view of the cover assembly of the jump pit system of FIG. 1.

With reference to FIGS. 8-11, retractable cover assembly 300 includes a housing 310, a plurality of access panels 320, 322, and 324 (FIG. 8), and retractable cover 400 (FIG. 8). The access panels may be lockable and may include retractable handles 325. Other access panels for retractable cover assemblies may be hinged or pivotally attached to the housing. Retractable cover assembly 300 is disposable and/or attachable to minor side 103 (FIG. 5) of base form 100 (FIG. 5) such as the far side of the sand area.

Figure 9:
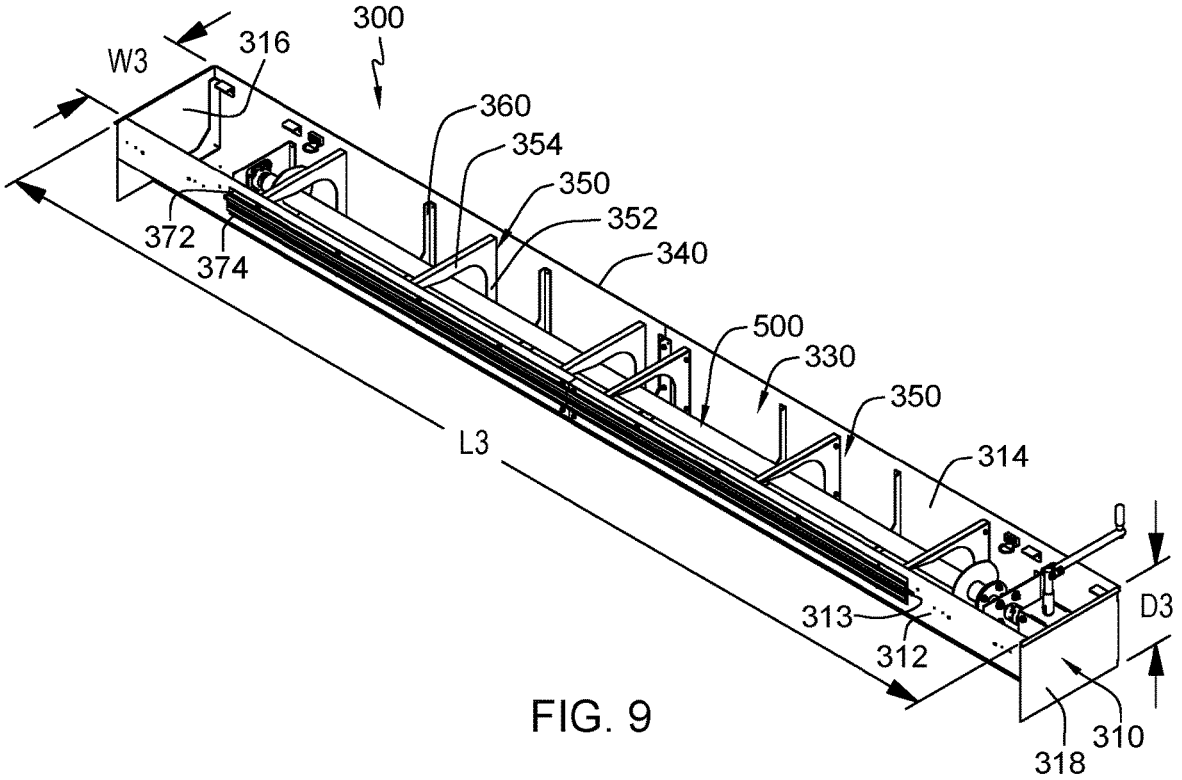
FIG. 9 is an enlarged perspective view of the cover assembly of FIG. 8 with the access panels removed.

As shown in FIG. 9, housing 310 may include a major inner wall 312, a major outer wall 314, a first minor end wall 316, a second minor end wall 318, a lower bottom wall 320 (FIG. 14), and an upper bottom wall 322 (FIG. 14) that define a chamber 330 therein having an upper opening 340. In some embodiments, a housing may include a right half and a left half that is operably connected together such as with one or more alignment plates and/or support bars, overlapping portions, or other suitable connecting means. The housing may include a length L3 of about 13 feet, a width W3 of about 1 foot, and a depth D3 of about 1 foot.

Figure 14:
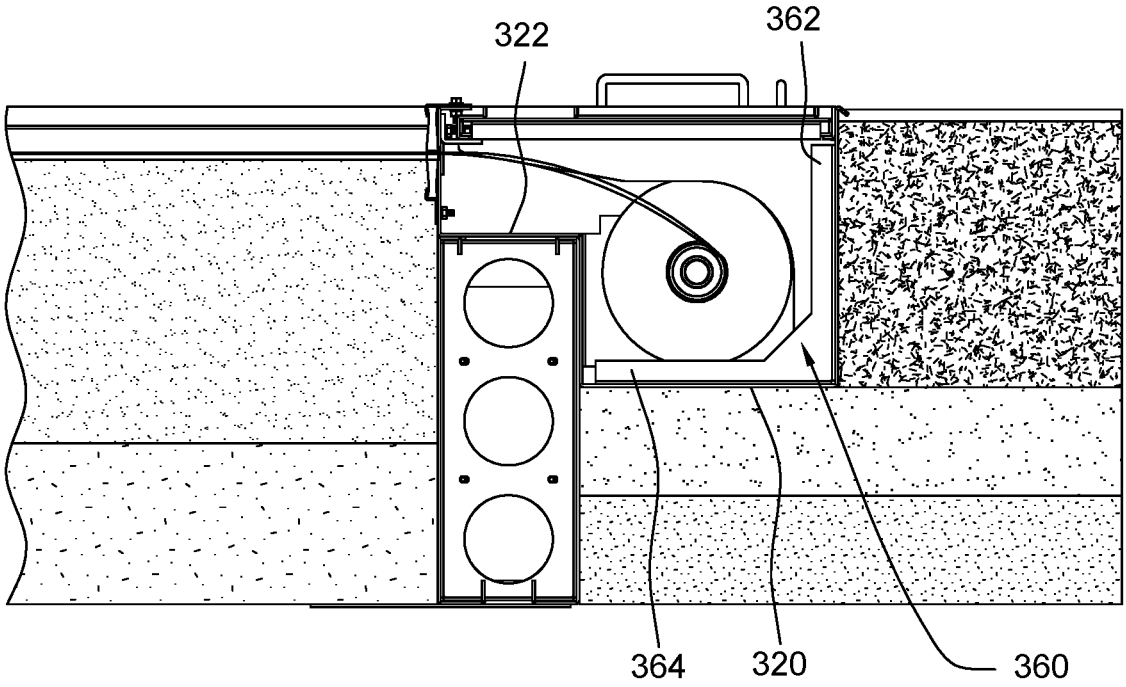
FIG. 14 is a cross-sectional view of the cover assembly of FIG. 1 installed in an athletic field.

To strengthen housing 310, a plurality of L-shaped brackets 350 may be disposed in chamber 330 and operably attached to housing 310. For example, L-shaped brackets 350 may include a first vertical leg 352 that extends along and is operably attached to major side wall 314, and a second horizontal leg 354 that extends across housing 310 and is operably attached at an end thereof to major inner wall 312. A plurality of L-shaped brackets 360 (also shown in FIG. 14) may include a first vertical leg 362 (FIG. 14) that extends along and is operably attached to major outer wall 314, and a second horizontal leg 364 (FIG. 14) operably attached to lower bottom wall 320 (FIG. 14). For example, the brackets may be welded or attached with bolts and nuts, or other suitable attachment means. The housing, walls, and brackets may be formed from a metal material such as steel or aluminum.

As shown in FIGS. 8 and 9, inner major wall 312 may include an opening or slot 313 sized so that retractable cover 400 (FIG. 8) may pass through slot 313. An upper debris brush 372 (FIG. 9) and a lower debris brush 374 (FIG. 9) may be attached to major inner wall 312 and extend across slot 313 (FIG. 9) for removing debris when retractable cover 400 (FIG. 8) is retracted.

Retractable cover assembly 300 may include an elongated rotatable member 500 (FIG. 9) upon which retractable cover 400 (FIG. 8) may be operably attached and rolled up when retractable cover 400 (FIG. 8) is stored in a compacted configuration in chamber 330 (FIG. 9) of housing 310. The elongated member may be, for example, a hollow tube.

Figure 10:
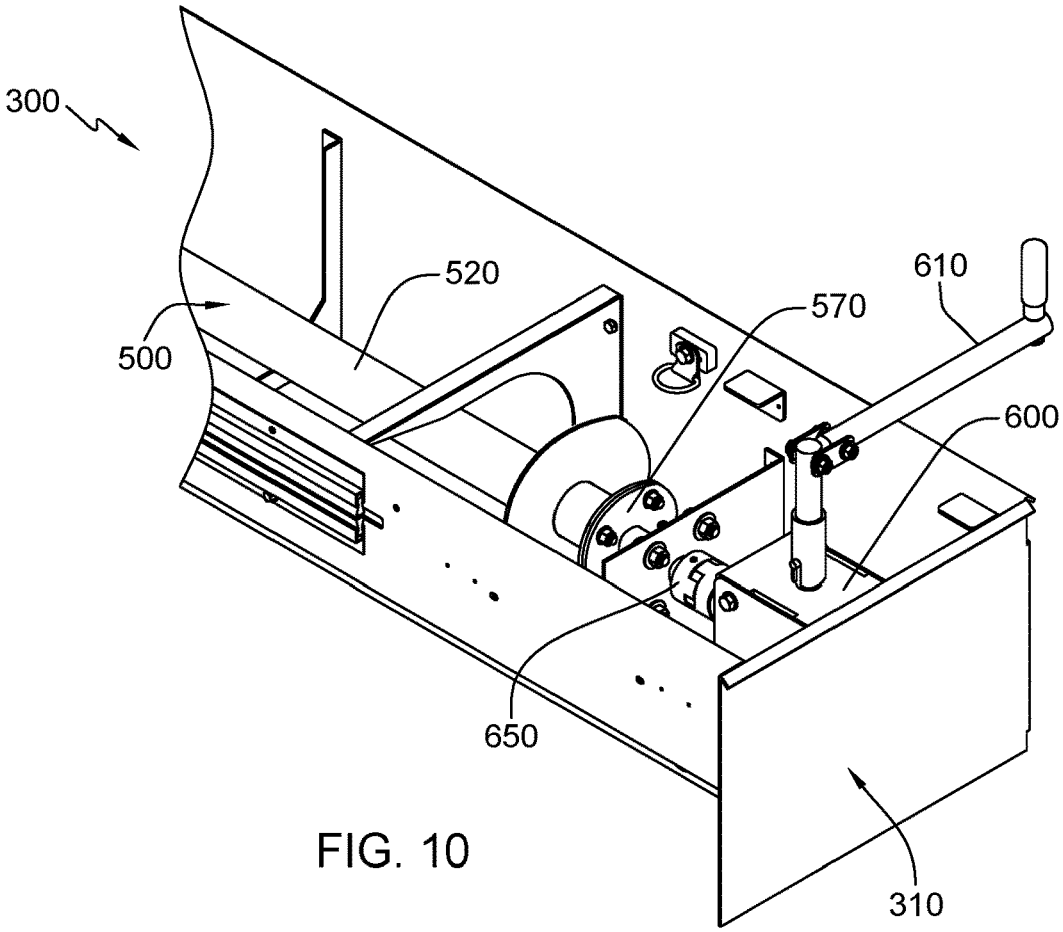
FIG. 10 is an enlarged perspective view of one end of the cover assembly of FIG. 9.
Figure 11:
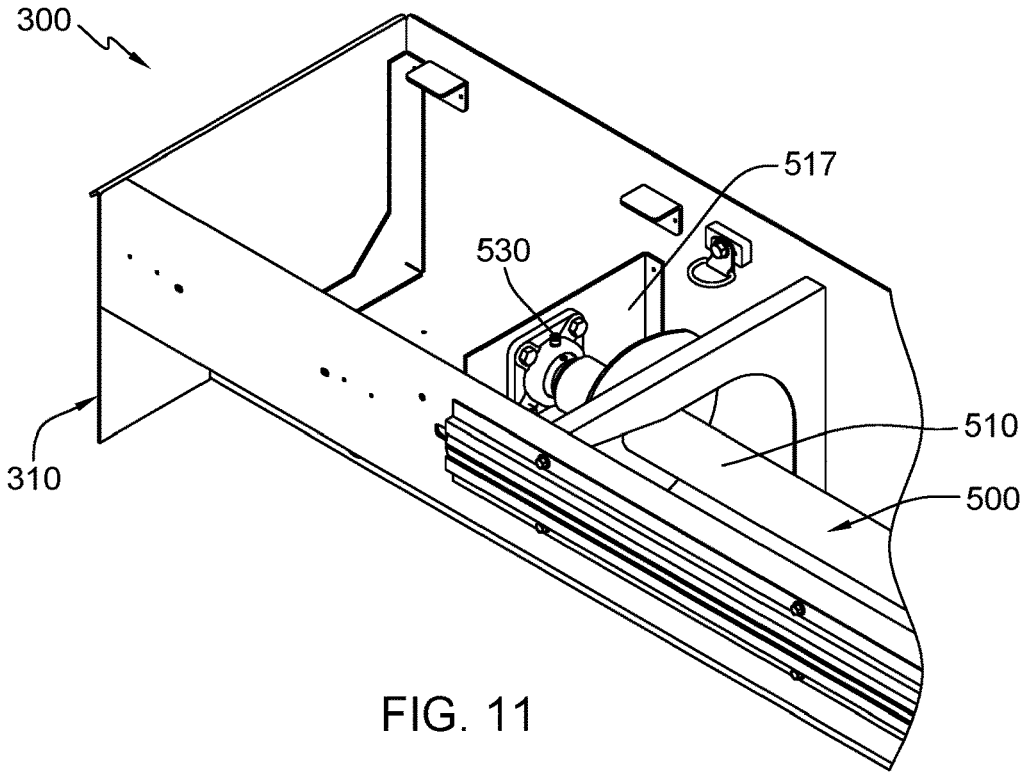
FIG. 11 is an enlarged perspective view of the other end of the cover assembly of FIG. 9.
Figure 12:
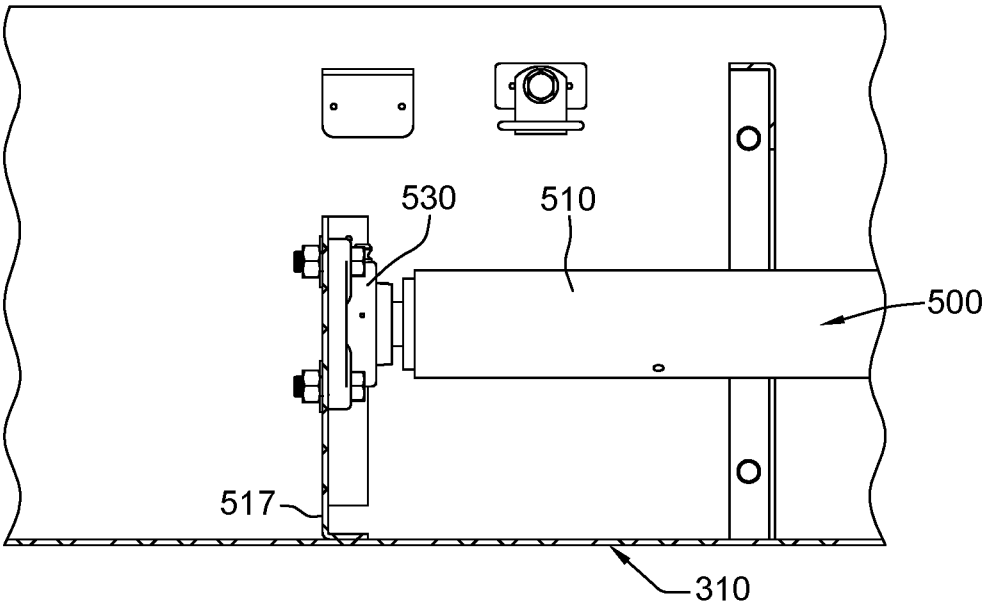
FIG. 12 is a side view, in part cross-section, of the portion of the cover assembly of FIG. 11.
Figure 13:
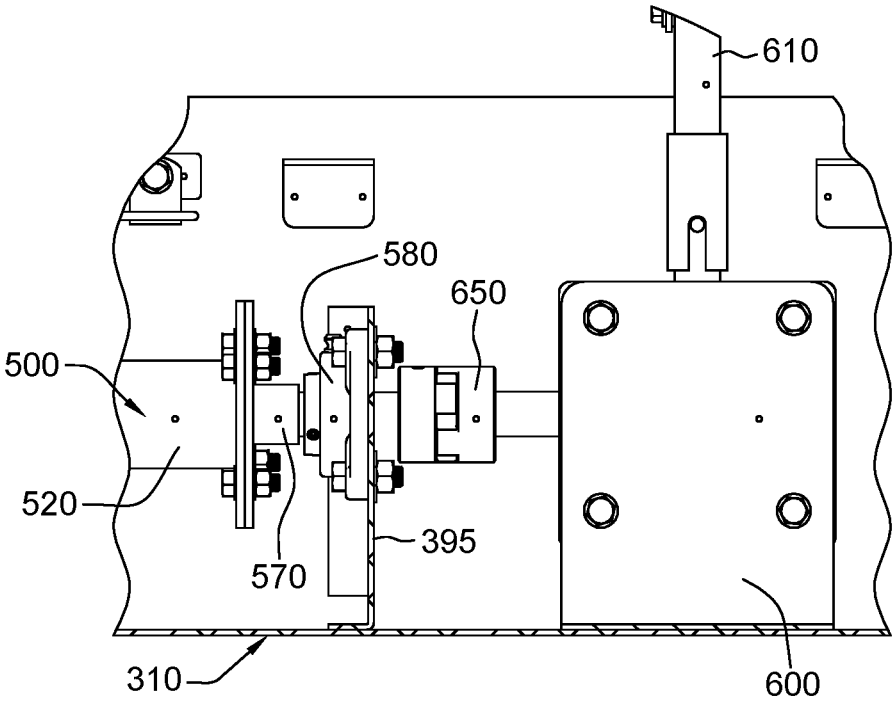
FIG. 13 is a side view, in part cross-section, of the portion of the cover assembly of FIG. 10.

With reference to FIGS. 10-13, elongated rotatable member 500 may include a first end portion 510 (FIGS. 11 and 12) and a second end portion 520 (FIGS. 10 and 13). As shown in FIGS. 11 and 12, first end portion 510 may be operably rotatably supported by a bearing 530. Bearing 530 may be supported in housing 310 by a bracket 517.

As shown in FIGS. 10 and 13, end portion 520 may be operably connected to a mounting stub 570, which mounting stub 570 is operably connected to a bearing 580 (FIG. 13). Bearing 580 (FIG. 13) may be supported in housing 310 by a bracket 395 (FIG. 13). Rotatable member 500 may be rotated by an operator, such as when retracting the retractable cover. For example, a gear box 600 having a crank handle 610 may be operably connected to rotatable member 500 via a coupler 650 such as a Lovejoy coupler.

Figure 15:
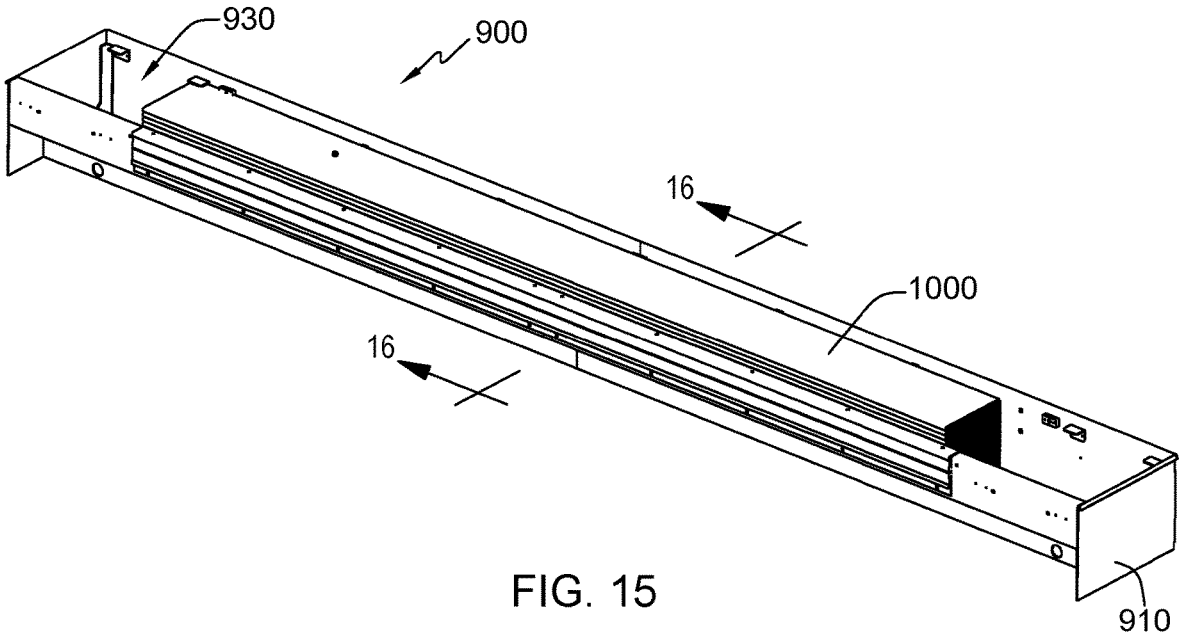
FIG. 15 is a perspective view of a portion of a cover assembly according to an embodiment of the present disclosure.
Figure 16:
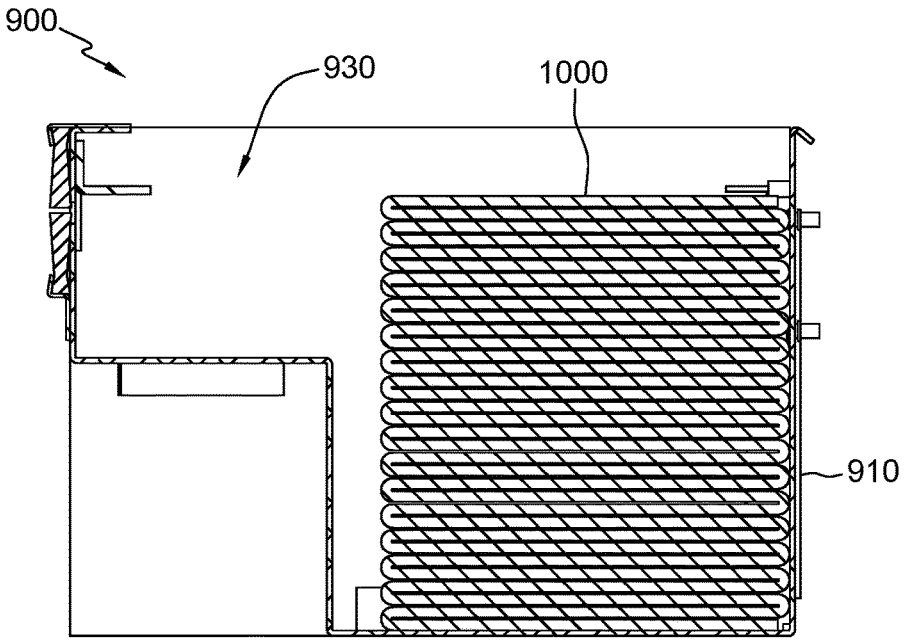
FIG. 16 is a cross-section taken along line 16-16 of FIG. 15.

FIGS. 15 and 16 illustrate a cover assembly 900 having a cover 1000 such as a folding cover according to an embodiment of the present disclosure for use in a jump pit system. For example, cover assembly 900 may include a housing 910 having a chamber 930 therein and one or more access panels (not shown in FIGS. 15 and 16). Cover 1000 may be manually folded as shown or rolled up and placed in the chamber of the housing in a compacted storable configuration. The folded or rolled cover may be removed from the retractable cover assembly unfolded or unrolled and placed over a sand area. Suitable edge portions of the cover may be operably attached to the inner portion of the sand catcher or other structure such as with releasably attachable connectors. The housing may include a length of about 13 feet, a width of about 1 foot, and a depth of about 1 foot.

Figure 17:
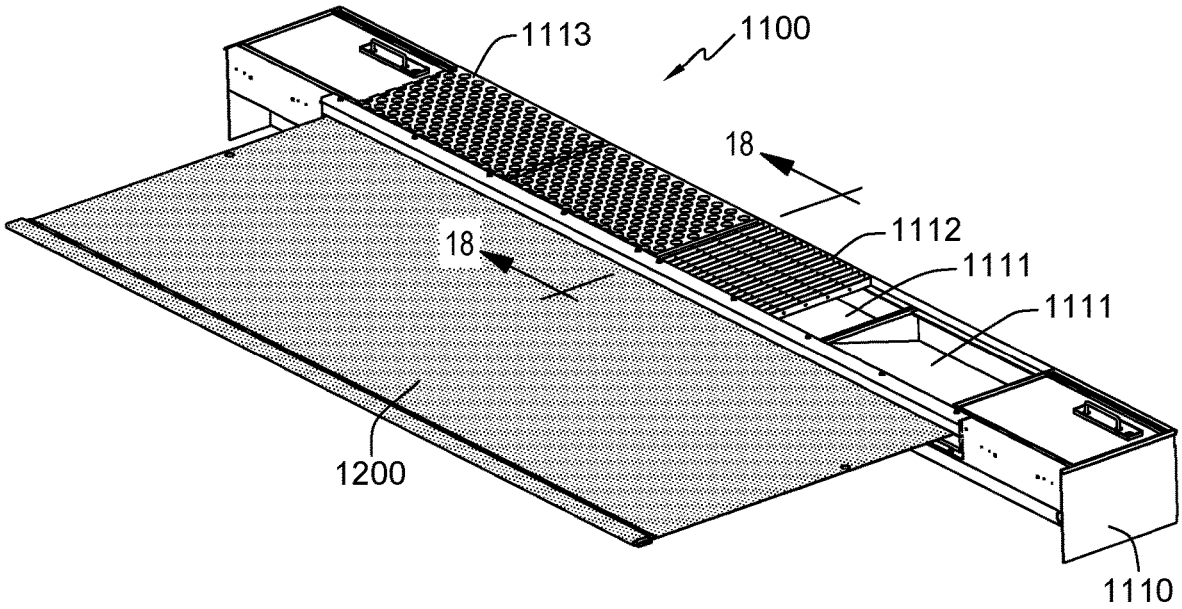
FIG. 17 is a perspective view of a portion of a cover assembly according to an embodiment of the present disclosure.
Figure 18:
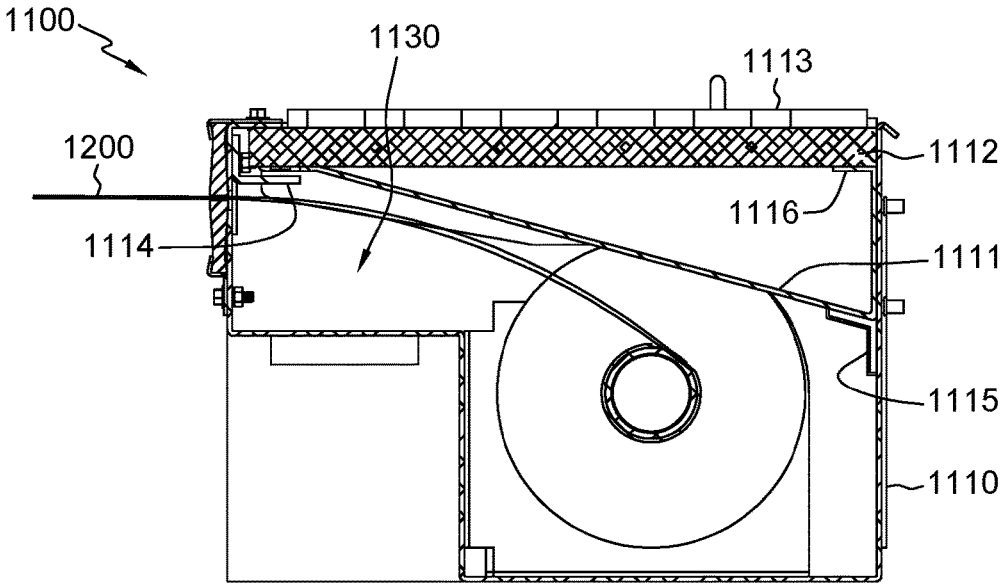
FIG. 18 is a cross-section taken along line 18-18 of FIG. 17.

FIGS. 17 and 18 illustrate a cover assembly 1100 having a cover 1200 operable, which cover assembly also acts as a sand catcher according to an embodiment of the present disclosure for use in a jump pit system. For example, retractable cover assembly 1100 may include a housing 1110 having a chamber 1130 (FIG. 18) therein, one or more sand catcher trays 1111, one or more grates 1112 having passageways therethrough, and one or more mats 1113 having passageways therethrough. The sand catcher trays may be supported at one end by a bracket 1114 (FIG. 18) at the other end by a bracket 1115 (FIG. 18). The mats are disposed on top of the grates, which are disposed over the sand catcher trays. For example, sand catcher tray 1111 may have an inwardly-extending portion 1116 (FIG. 18) for supporting a bottom portion of grate 1112. The mats, grates, and sand catcher trays may have a width that covers chamber 1130 (FIG. 18). The sand catcher trays may be sloped and have a bottom that is disposed above the retracted cover disposed on a rotatable member in the cover assembly. In other embodiments, sand catcher trays may have a horizontal bottom. In still other embodiments, cover assemblies for containing a folded cover may employ sand catcher trays, grates and mats so that the cover assembly also acts as a sand trap.

Figure 19:
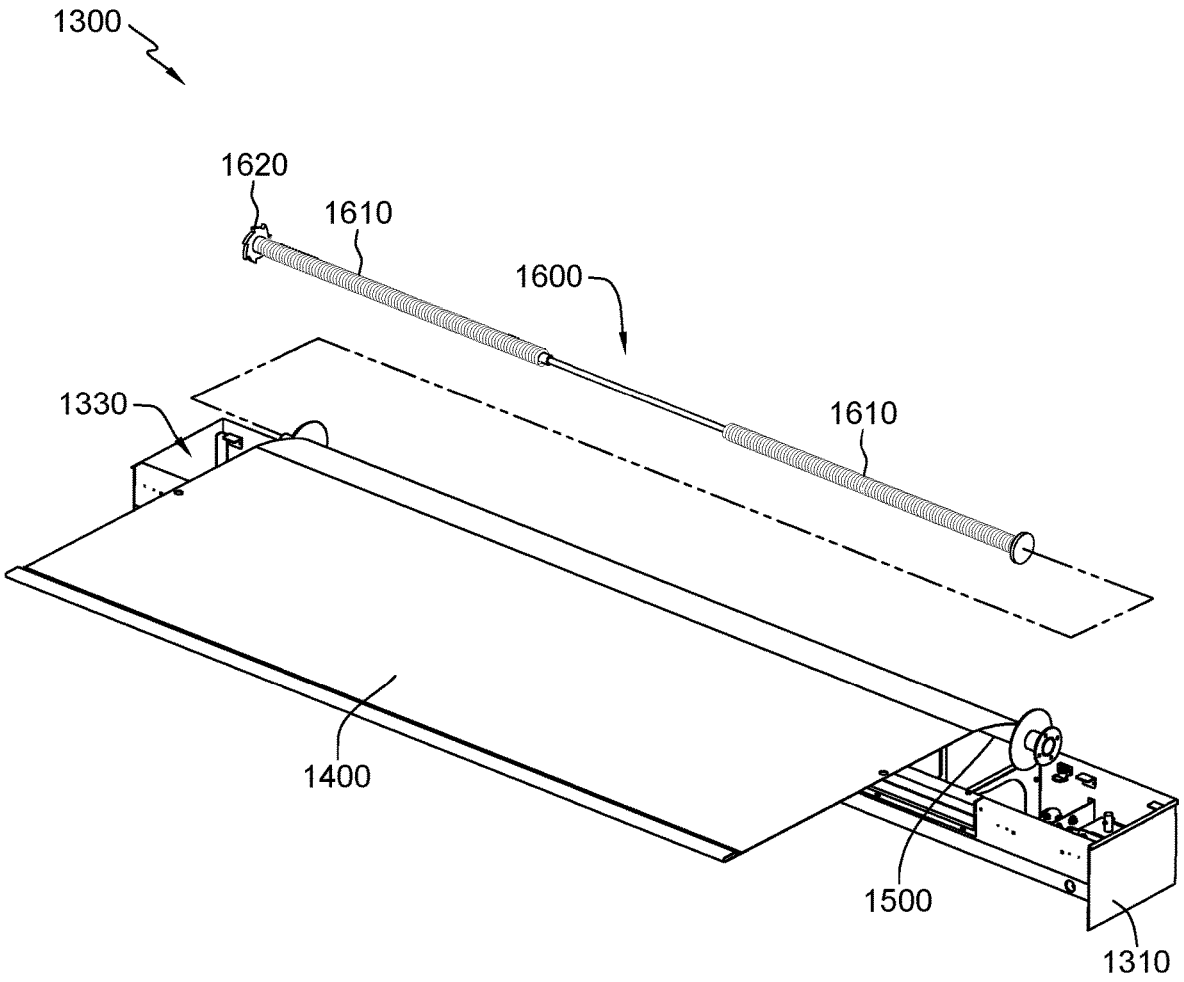
FIG. 19 is an exploded perspective view of a portion of a cover assembly according to an embodiment of the present disclosure.

FIG. 19 illustrates a cover assembly 1300 such as a retractable cover assembly having a cover 1400 such as an automatically retractable cover according to an embodiment of the present disclosure for use in a jump pit system. For example, retractable cover assembly 1300 may include a housing 1310 having a chamber 1330 therein, a hollow rotatable member 1500, and means for retracting cover 1400 or an automatic retraction assembly 1600 for retracting cover 1400. For example, automatic retraction assembly 1600 may be disposable in hollow rotatable member 1500. Automatic retraction assembly 1600 may include one or more torsions springs 1610, a ratchet 1620, and a pawl (not shown) to inhibit retraction of an extended cover 1400. Disengagement of the pawl allows retraction and automatic rolling up of the extended cover. It will be appreciated that suitable means for retracting cover may be incorporated in the retractable cover assemblies described herein.

Figure 20:
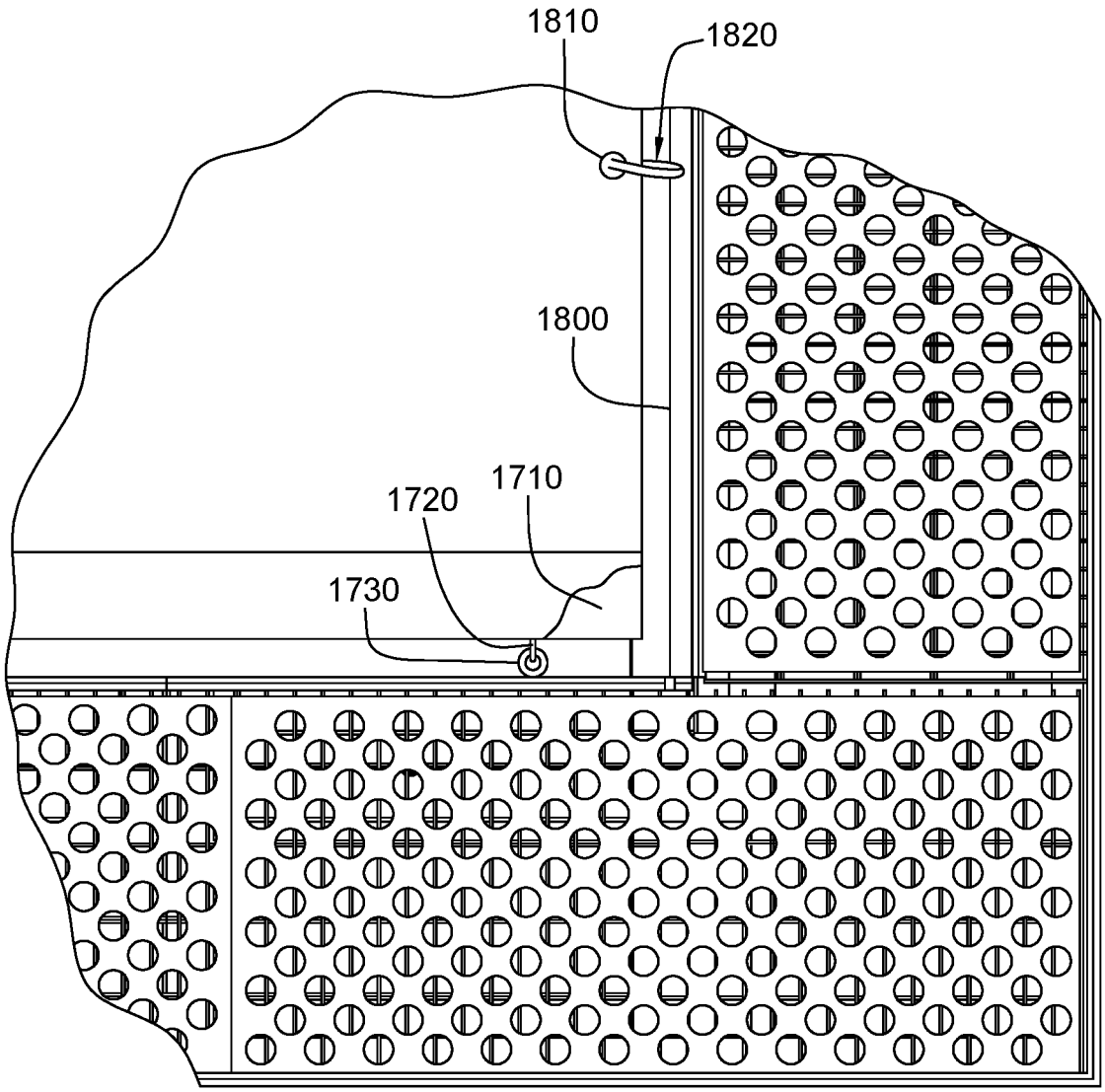
FIG. 20 is a top view of a front portion of a jump pit system according to an embodiment of the present disclosure.

With reference to FIG. 20, the retractable covers disclosed herein may include a rigid bar 1710 such as a ½ inch by 2 inches aluminum bar enclosed in the end of the cover and extending across the width of the cover. The cover may also include hooks 1720 that operably connect to eye bolts 1730 attached to the inner side of the housing of the sand catcher adjacent to the near end or minor side of the jump pit assembly.

In the various embodiments, the longitudinal sides of the cover may be slidably attached to the longitudinal sides of the jump pit assembly. For example, a pair of wires 1800 (only one of which is shown in FIG. 20) may be disposed adjacent to the two inner longitudinal sides of the housing of the sand catcher. For example, wires 1800 may be ⅛ inch cables that run the length of the jump pit assembly. The cover may include a plurality of apertures 1810 (only one shown in FIG. 20) disposed adjacent to the longitudinal sides of the cover. A plurality of releasably attachable clips 1820 may operably connect the side of the cover to wire 1800. For example, releasably attachable clips may be suitable carabiners.

Figure 21:
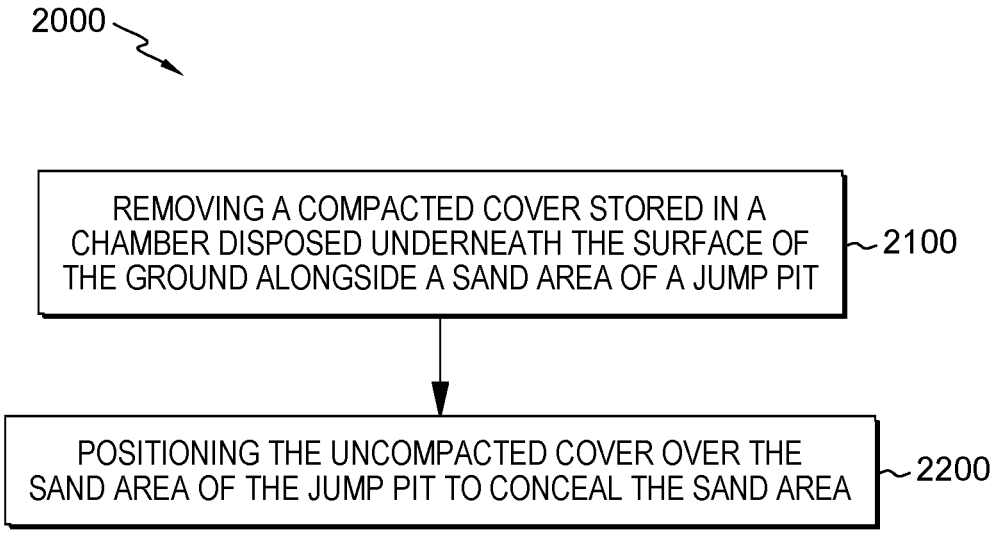
FIG. 21 is a flowchart of a method for covering a sand area of a jump pit.

FIG. 21 illustrates a method 2000 for covering a sand area of a jump pit. Method 2000 may include, for example, at 2100 removing a compacted cover stored in a chamber underneath the surface of the ground alongside a sand area of a jump pit, and at 2200 positioning the uncompacted cover over the sand area of the jump pit to conceal the sand area.

In the various embodiments, the elongated cover may be a monolithic elongated cover or one piece elongated cover sized to extend over and cover such as completely or entirely cover the sand area. For example, the elongated cover may be a collapsible, rollable, foldable resilient sheet-like material such as a vinyl/mesh cover. Such elongated cover may have a width of about 10 feet and a length of about 30 feet. In other embodiments, the elongated cover may be stretchable having a size when stretched to extend over and cover such as completely or entirely cover the sand area.

From the present discussion, it will be appreciated that the present disclosure may provide a convenient and practical sand pit cover that results in a securely fastened cover that will not displace as a result of wind, and provides for quick and easy integral storage for the end-user. The present disclosure may serve as the primary sand pit cover, or may serve as a convenient seasonal cover for those that prefer to utilize for example, solid aluminum cover panels during the offseason.

From the present description, it will be appreciated that a retractable cover disposable in the chamber adjacent to the jump pit may provide a system easily operable by field personnel for covering a sand area of a jump pit compared to metal cover panels that are heavy, and which can make for a cumbersome process if the covers (e.g., the smallest common size covering approximately 12 feet by 25 feet) are being taken on and off with regularity.

From the present description, it will be appreciated that a retractable cover operably attached to a housing and to a base frame, cap, or sand catcher may overcome the problem of conventional vinyl/mesh covers that have a tendency to shift as a result of wind despite the added perimeter weight.

The present disclosure may overcome the problem of using conventional aluminum panels, which are left stacked and off to the side during tack season or requiring carrying and placing in storage when the sand pit is routinely being used. The present disclosure also overcomes the problem that it is difficult and inconvenient to store cover panels of this size when they aren't in use, particularly if the facility has multiple sand pits.

It is to be understood that the above description is intended to be illustrative, and not restrictive. For example, the above-described embodiments and/or features thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that features of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A jump pit system for use with a sand area of a jump pit, said jump pit system comprising:

a base form having a first side, a second side, and spaced-apart sides extending from said first side to said second side, said base form to define the sand area of the jump pit;

a retractable cover assembly operably attachable to and disposable over said first side and portions of said spaced-apart sides of said base form, said retractable cover assembly comprising:

a housing comprising:

an inner major wall having a first height;

an outer major wall having a second height greater than said first height;

an inner upper bottom wall secured to said bottom of said inner major wall;

an outer lower bottom wall secured to said outer major wall;

a first minor end wall secured to an end of said inner major wall, an end of said outer major wall, an end of said inner upper bottom wall, and an end of said outer lower bottom wall;

a second minor end wall secured to an opposite end of said inner major wall, an opposite end of said outer major wall, an opposite end of said inner upper bottom wall, and an opposite end of said outer lower bottom wall;

said inner upper bottom wall extending across and supportable on said first side of said base form and on portions of said spaced-apart sides above said base form;

said inner major wall extending across and supportable on said first side of said base form and on portions of said spaced-apart sides above said base form;

said walls of said housing defining a chamber therein, said chamber being disposable in the ground;

a rotatable member disposed in said chamber of said housing and extending along said first side of said base form and portions of said spaced-apart sides of said base form, a first bracket attached to said outer bottom wall and to said outer major wall for operably supporting a first end of said rotatable member, and a second bracket attached to said outer bottom wall and to said outer major wall for operably supporting a second end of said rotatable member;

a gear box disposed in said chamber of said housing between said first minor end wall and said first bracket, said gear box having an output shaft operably attached to a first end of said rotatable member, and said gear box having an input shaft disposed upwardly and 90-degrees from said output shaft;

a handle releasably attachable to said input shaft of said gearbox, said handle extendable and rotatable above said chamber of said housing;

an elongated cover having a first end attached to said rotatable member, a second end, and spaced-apart sides extending from said first end to said second end;

at least one access panel extending across said chamber of said housing from said inner major wall to said outer major wall and from said first minor end wall to said second minor end wall, and extending over portions of said spaced-apart sides of said base form;

a first sand catcher attached to a first said spaced-apart sides of said base form and abutting a first inwardly facing surface of said inner major wall of said retractable cover assembly and having an outer wall aligned with said first minor end wall of said retractable cover assembly, and a second sand catcher attached to a second of said spaced-apart sides of said base form and abutting a second inwardly facing surface of said inner major wall of said retractable cover assembly and having an outer wall aligned with said second minor end wall of said retractable cover assembly;

one or more connectors;

wherein said elongated cover is rolled up on said elongated member and storable in a compacted configuration in said chamber of said housing below the surface of the ground; and wherein said elongated cover is unwound from said elongated member and removable from said chamber and extendable in an uncompacted configuration and secured with said one or more connectors over the sand area of the jump pit to conceal the sand area.

2. The jump pit system of claim 1 further comprising a biasing member for automatically rotating said rotatable member.

3. The jump pit system of claim 1 wherein said housing comprises said inner major wall facing the sand area and said inner major wall comprises an elongated slot, and said elongated cover extendable in said uncompacted configuration over the sand area of the jump pit to conceal the sand area extends through said slot.

4. The jump pit system of claim 3 wherein said housing comprises brushes extending adjacent and along said elongated slot.

5. The jump pit system of claim 1 further comprising one or more sand catcher trays disposed in said chamber in said housing.

6. The jump pit system of claim 5 wherein said one or more sand catcher trays comprises a sloped bottom.

7. The jump pit system of claim 1 wherein said elongated cover comprises a monolithic elongated cover having a width of 10 feet and a length of 30 feet.

8. The jump pit system of claim 1 wherein said elongated cover comprises a rigid member disposed along said first end of said elongated cover.

9. The jump pit system of claim 1 wherein said elongated cover comprises a mesh cover.

10. The jump pit system of claim 1 further comprising one or more sand catcher trays disposed in said chamber in said housing, and at least one of one or more grates and one or more mats disposable over said one or more sand catcher trays.

11. The jump pit system of claim 1 wherein said base form comprises an inside wall, an outside wall, and a plurality of support members disposed between said inside wall and said outside wall, and said retractable cover assembly operably attachable to said first side of said base form and disposed above said base form.

12. The jump pit system of claim 1 further comprising a pair of cables, said pair of cables extendable along opposite sides of the sand area for securing corresponding sides of said elongated cover extendable in said uncompacted configuration over the sand area of the jump pit to conceal the sand area.

13. The jump pit system of claim 1 wherein said one or more sand catchers comprises one or more sand catchers attachable to and extendable along said second side of said base form.

14. The jump pit system of claim 1 wherein said housing comprises length of 13 feet, a width of 1 foot, and a depth of 1 foot.

15. The jump pit system of claim 1 further comprising a plurality of rigid cover panels.

16. A method comprising:

unwinding the compacted cover stored in the chamber of the jump pit system of claim 1 disposed underneath a surface of the ground alongside the sand area of the jump pit:

positioning the uncompacted cover over the sand area of the jump pit to conceal the sand area; and fixedly securing the uncompacted cover over the sand area with the one or more connectors.

17. The method of claim 16 further comprising:

operating the crank attached to the gear box to wind up the elongated cover on the elongated member in the chamber of the housing.

18. A method comprising:

unwinding a compacted cover stored in a chamber of a jump pit system disposed underneath a surface of the ground alongside a sand area of a jump pit, the jump pit system comprising:

a base form having a first side, a second side, and spaced-apart sides extending from the first side to the second side to define the sand area of the jump pit;

a retractable cover assembly operably attachable to and disposable over the first side and portions of the spaced-apart sides of the base form, the retractable cover assembly comprising:

a housing comprising:

an inner major wall having a first height;

an outer major wall having a second height greater than the first height;

an inner upper bottom wall secured to the bottom of the inner major wall;

an outer lower bottom wall secured to the outer major wall;

a first minor end wall secured to an end of the inner major wall, an end of the outer major wall, an end of the inner upper bottom wall, and an end of the outer lower bottom wall;

a second minor end wall secured to an opposite end of the inner major wall, an opposite end of the outer major wall, an opposite end of the inner upper bottom wall, and an opposite end of the outer lower bottom wall;

the inner upper bottom wall supportable on the first side of the base form and on portions of the spaced-apart sides above the base form;

the inner major wall extending the length of the first side and across portions of the spaced-apart sides;

the walls of the housing defining a chamber therein, the chamber being disposable in the ground;

an elongated cover having a first end, a second end, and spaced-apart sides extending from the first end to the second end;

a rotatable member disposed in the chamber of the housing and extending along the first side of the base form and portions of the spaced-apart sides of the base form, a first bracket attached to the outer bottom wall and to the outer major wall for operably supporting a first end of the rotatable member, and a second bracket attached to the outer bottom wall and to the outer major wall for operably supporting a second end of the rotatable member;

a gear box disposed in the chamber of the housing between the first minor end wall and the first bracket, the gear box having an output shaft operably attachable to a first end of the rotatable member, and the gear box having an input shaft disposed upwardly and 90-degrees from the output shaft;

a handle releasably attachable to the input shaft of the gearbox, the handle extendable and rotatable above the chamber of the housing;

at least one access panel extending across the chamber of the housing from the inner major wall to the outer major wall and from the first minor end wall to the second minor end wall, and extending over portions of the spaced-apart sides of the base form;

a first cap or sand catcher attached to a first of the spaced-apart sides of the base form and abutting a first inwardly facing surface of the inner major wall of the retractable cover assembly and having an outer wall aligned with said first minor end wall of said retractable cover assembly, and a second cap or sand catcher attached to a second of the spaced-apart sides of the base form and abutting a second inwardly facing surface of the inner major wall of the retractable cover assembly and having an outer wall aligned with said second minor end wall of said retractable cover assembly;

one or more connectors;

wherein the elongated cover is storable on the rotatable member in the compacted configuration in the chamber of the housing below the surface of the ground;

wherein the elongated cover is removable from the elongated member in the chamber and extendable in an uncompacted configuration over the sand area of the jump pit to conceal the sand area;

positioning the uncompacted cover over the sand area of the jump pit to conceal the sand area; and fixedly securing the uncompacted cover over the sand area with the one or more connectors.

19. The method of claim 18 wherein the jump pit system further comprises one or more sand catchers attached to the spaced-apart sides of the base form.

20. A jump pit system for use with a sand area of a jump pit, said jump pit system comprising:

a base form having a first side, a second side, and spaced-apart sides extending from said first side to said second side to define the sand area of the jump pit, said base form having an inside wall, an outside wall, and a plurality of support members disposed between said inside wall and said outside wall;

a retractable cover assembly operably attachable to and disposable over said first side and portions of said spaced-apart sides of said base form, said retractable cover assembly comprising:

a housing comprising:

an inner major wall having a first height;

an outer major wall having a second height greater than said first height;

an inner upper bottom wall secured to said bottom of said inner major wall;

an outer lower bottom wall secured to said outer major wall;

a first minor end wall secured to an end of said inner major wall, an end of said outer major wall, an end of said inner upper bottom wall, and an end of said outer lower bottom wall;

a second minor end wall secured to an opposite end of said inner major wall, an opposite end of said outer major wall, an opposite end of said inner upper bottom wall, and an opposite end of said outer lower bottom wall;

said inner upper bottom wall extending across and supportable on said first side of said base form and on portions of said spaced-apart sides above said base form;

said inner major wall extending across and supportable on said first side of said base form and on portions of said spaced-apart sides above said base form;

said walls of said housing defining a chamber therein, said chamber being disposable in the ground;

a rotatable member disposed in said chamber of said housing and extending along said first side of said base form and portions of said spaced-apart sides of said base form, a first bracket attached to said outer bottom wall and to said outer major wall for operably supporting a first end of said rotatable member, and a second bracket attached to said outer bottom wall and to said outer major wall for operably supporting a second end of said rotatable member;

a gear box disposed in said chamber of said housing between said first minor end wall and said first bracket, said gear box having an output shaft operably attachable to a first end of said rotatable member, and said gear box having input shaft disposed upwardly and 90-degrees from said output shaft;

a handle releasably attachable to said input shaft of said gearbox, said handle extendable and rotatable above said chamber of said housing;

an elongated cover having a first end attached to said rotatable member, a second end, and spaced-apart sides extending from said first end to said second end;

at least one access panel extending across said chamber of said housing from said inner major wall to said outer major wall and from said first minor end wall to said second minor end wall, and extending over portions of said spaced-apart sides of said base form;

a first cap attached to a first said spaced-apart sides of said base form and abutting a first inwardly facing surface of said inner major wall of said retractable cover assembly and having an outer wall aligned with said first minor end wall of said retractable cover assembly, and a second cap attached to a second of said spaced-apart sides of said base form and abutting a second inwardly facing surface of said inner major wall of said retractable cover assembly and having an outer wall aligned with said second minor end wall of said retractable cover assembly;

one or more connectors;

wherein said elongated cover is rolled up on said elongated member and storable in a compacted configuration in said chamber of said housing below the surface of the ground; and wherein said elongated cover is unwound from said elongated member and removable from said chamber and extendable in an uncompacted configuration and secured with said one or more connectors over the sand area of the jump pit to conceal the sand area.

21. The jump pit system of claim 20 wherein said inner major wall comprises an elongated slot, and said elongated cover extendable in said uncompacted configuration over the sand area of the jump pit to conceal the sand area extends through said slot, and said housing comprising brushes extending adjacent and along said elongated slot.

22. The jump pit system of claim 20 further comprising one or more sand catcher trays disposed in said chamber in said housing.

23. The jump pit system of claim 20 further comprising at least one sand catcher attached to said spaced-apart sides of said base form.

24. The jump pit system of claim 20 further comprising a pair of cables, said pair of cables extendable along opposite sides of the sand area for securing corresponding sides of said elongated cover extendable in said uncompacted configuration over the sand area of the jump pit to conceal the sand area.

25. The jump pit system of claim 20 further comprising a plurality of rigid cover panels.

26. A method comprising:

unwinding the compacted cover stored in the chamber of the jump pit system of claim 20 disposed underneath a surface of the ground alongside the sand area of the jump pit:

positioning the uncompacted cover over the sand area of the jump pit to conceal the sand area; and fixedly securing the uncompacted cover over the sand area with the one or more connectors.

27. The method of claim 26 wherein the jump pit system further comprises at least one sand catcher attached to the spaced-apart sides of the base form.

28. The method of claim 26 further comprising:

operating the crank attached to the gear box to wind up the elongated cover on the elongated member in the chamber of the housing.

29. The jump pit system of claim 20 wherein said elongated cover comprises a mesh cover.

* * * * *